US011605921B2

(12) United States Patent
Yang et al.

(10) Patent No.: US 11,605,921 B2
(45) Date of Patent: Mar. 14, 2023

(54) ELECTRICAL CONNECTOR

(71) Applicant: JESS-LINK PRODUCTS CO., LTD., New Taipei (TW)

(72) Inventors: Yun-Chang Yang, New Taipei (TW); Ching-Hung Liu, New Taipei (TW); Siang-Ting Wang, New Taipei (TW)

(73) Assignee: JESS-LINK PRODUCTS CO., LTD., New Taipei (TW)

( * ) Notice: Subject to any disclaimer, the term of this patent is extended or adjusted under 35 U.S.C. 154(b) by 22 days.

(21) Appl. No.: 17/367,597

(22) Filed: Jul. 5, 2021

(65) Prior Publication Data

US 2022/0166168 A1 May 26, 2022

(30) Foreign Application Priority Data

Nov. 24, 2020 (TW) ..... 109141162

(51) Int. Cl.
*H01R 13/6471* (2011.01)
*H01R 13/6473* (2011.01)
*H01R 13/24* (2006.01)

(52) U.S. Cl.
CPC ..... *H01R 13/6471* (2013.01); *H01R 13/24* (2013.01); *H01R 13/6473* (2013.01)

(58) Field of Classification Search
CPC ..... H01R 13/02; H01R 13/6473; H01R 13/6476; H01R 13/6585; H01R 13/6586; H01R 13/24; H01R 13/6591; H01R 13/65912; H01R 13/65914;
(Continued)

(56) References Cited

U.S. PATENT DOCUMENTS 6,231,355 B1 * 5/2001 Trammel ..... H01R 12/721 439/79
6,685,510 B1 * 2/2004 Wu ..... H01R 13/514 439/607.06
(Continued)

FOREIGN PATENT DOCUMENTS

CN 107394442 A * 11/2017 ..... H01R 13/02
CN 111628320 A * 9/2020 ..... H01R 13/02
(Continued)

OTHER PUBLICATIONS

Office Action dated Aug. 9, 2021 of the corresponding Taiwan patent application No. 109141162.

*Primary Examiner* — Marcus E Harcum
(74) *Attorney, Agent, or Firm* — Chun-Ming Shih; HDLS IPR Services

(57) ABSTRACT

A connector includes multiple ground terminals, multiple signal terminals, a cable and a ground assembly. The cable includes multiple ground wires and multiple signal wires. The ground assembly includes a plate and multiple protrusion structures. Each protrusion structure is arranged spacedly and extended from the plate. A top of each protrusion structure is higher than a surface of the plate. Each ground wire is electrically connected with each ground terminal and each protrusion structure. Each signal wire is electrically connected with each signal terminal. Each signal wire is formed between any two of the protrusion structures adjacent to each other. Therefore, high-speed transmission of digital signals may be undistortedly implemented.

9 Claims, 5 Drawing Sheets

(58) Field of Classification Search
CPC ..... H01R 13/6592; H01R 13/6597; H01R 13/6461; H01R 13/6471; H01R 13/6581; H01R 24/60
USPC .... 439/94, 98, 108, 660, 92, 607.41, 607.52
See application file for complete search history.

(56) References Cited

U.S. PATENT DOCUMENTS

| | | | | |
|---|---|---|---|---|
| 6,764,342 | B2 * | 7/2004 | Murayama | H01R 13/65918 439/607.1 |
| 7,530,839 | B1 * | 5/2009 | Lee | H01R 12/592 439/496 |
| 9,490,588 | B2 * | 11/2016 | Keyser | H01R 12/53 |
| 9,496,657 | B1 * | 11/2016 | Chang | H01R 13/6471 |
| 9,972,945 | B1 * | 5/2018 | Huang | H01R 13/6585 |
| 9,979,136 | B1 * | 5/2018 | Wu | H01R 13/6597 |
| 10,050,369 | B1 * | 8/2018 | Yang | H01R 13/502 |
| 10,084,245 | B2 * | 9/2018 | Chang | H01R 13/6658 |
| 10,218,088 | B2 * | 2/2019 | Chang | H01R 13/6586 |
| 10,374,367 | B2 * | 8/2019 | Maesoba | H01R 13/6589 |
| 10,468,829 | B2 * | 11/2019 | Zerebilov | H01R 13/516 |
| 10,840,622 | B2 * | 11/2020 | Sasame | H01R 13/514 |
| 10,944,189 | B2 * | 3/2021 | Xu | H01R 12/75 |
| 11,114,807 | B2 * | 9/2021 | Lloyd | H01R 24/60 |
| 2005/0095912 | A1 * | 5/2005 | Yang | H01R 13/65912 439/607.15 |
| 2011/0151716 | A1 * | 6/2011 | Kondo | H01R 13/6471 439/660 |
| 2015/0079845 | A1 * | 3/2015 | Wan | H01R 13/6477 439/607.41 |
| 2016/0049746 | A1 * | 2/2016 | Gross | H01R 13/6461 439/660 |
| 2018/0034216 | A1 * | 2/2018 | Zhong | H01R 4/027 |
| 2018/0183186 | A1 * | 6/2018 | Yu | H01R 13/40 |
| 2019/0181570 | A1 * | 6/2019 | Ellis | H01R 13/65914 |
| 2019/0252833 | A1 * | 8/2019 | Li | H01R 13/652 |
| 2020/0194911 | A1 * | 6/2020 | Ayzenberg | H01R 13/6594 |
| 2021/0234291 | A1 * | 7/2021 | Zerebilov | H01R 13/405 |
| 2021/0313721 | A1 * | 10/2021 | Little | H01R 12/71 |
| 2021/0313748 | A1 * | 10/2021 | Henry | H01R 13/642 |
| 2021/0399502 | A1 * | 12/2021 | Song | H01R 13/518 |
| 2022/0029360 | A1 * | 1/2022 | Little | H01R 13/65914 |
| 2022/0102918 | A1 * | 3/2022 | Kobayashi | H01R 13/65914 |
| 2022/0115817 | A1 * | 4/2022 | Huang | H01R 13/6471 |
| 2022/0173550 | A1 * | 6/2022 | Liu | H01R 13/6592 |

FOREIGN PATENT DOCUMENTS

| | | | | |
|---|---|---|---|---|
| CN | 113224597 | A | * | 8/2021 |
| CN | 113328296 | A | * | 8/2021 |
| TW | 566712 | U | | 12/2003 |
| TW | M521820 | U | | 5/2016 |
| TW | M609932 | U | | 4/2021 |

* cited by examiner

ELECTRICAL CONNECTOR

BACKGROUND

Technical Field

The disclosure relates to a technological field of a connector, particularly to a connector.

Related Art

A connection between a cable and a connector is usually implemented by a printed circuit board (PCB) or in a manner of soldering directly. Under the conditions of increasing transmission speed and decreasing overall sizes, how to reduce variation of characteristic impedance is an issue being researched.

A related-art connector usually uses a PCB to serve as an intermediate element. It is limited by the conditions of the art, the adjustment to the characteristic impedance is restrained. Also, if impedance matching is not implemented to remove reflection and reduce wave distortions, such as ringing, overshoot, and undershoot, etc., to guarantee the signal integrity of signals, the impedance variation may be excessive to worsen the signal integrity.

SUMMARY

An object of the disclosure is to provide a connector, which uses a ground assembly to undistortedly implement high-speed transmission of digital signals.

To accomplish the above object, the connector of the disclosure includes multiple ground terminals, multiple signal terminals, a cable and a ground assembly. The cable includes multiple ground wires and multiple signal wires. The ground assembly includes a plate and multiple protrusion structures. Each protrusion structure is arranged spacedly and extended from the plate. A top of each protrusion structure is higher than a surface of the plate. Each ground wire is electrically connected with each ground terminal and each protrusion structure. Each signal wire is electrically connected with each signal terminal. Each signal wire is formed between any two of the protrusion structures adjacent to each other.

The disclosure further has the following functions. The interference of the signal transmission of each signal wire and each signal terminal may be reduced by arranging the insulator and the recess to adjust the characteristic impedance. The interference of the signal transmission of each signal wire and each signal terminal may be reduced by arranging the opening on the plate to adjust the characteristic impedance.

In view of this, the inventors have devoted themselves to the abovementioned related art, researched intensively and cooperated with the application of science to try to solve the abovementioned problems. Finally, the disclosure which is reasonable and effective to overcome the above drawbacks is provided.

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Please refer to FIGS. 1-7. The disclosure provides a connector, which includes multiple ground terminals 10, multiple signal terminals 20, a cable 30 and a ground assembly 40.

Figure 1:
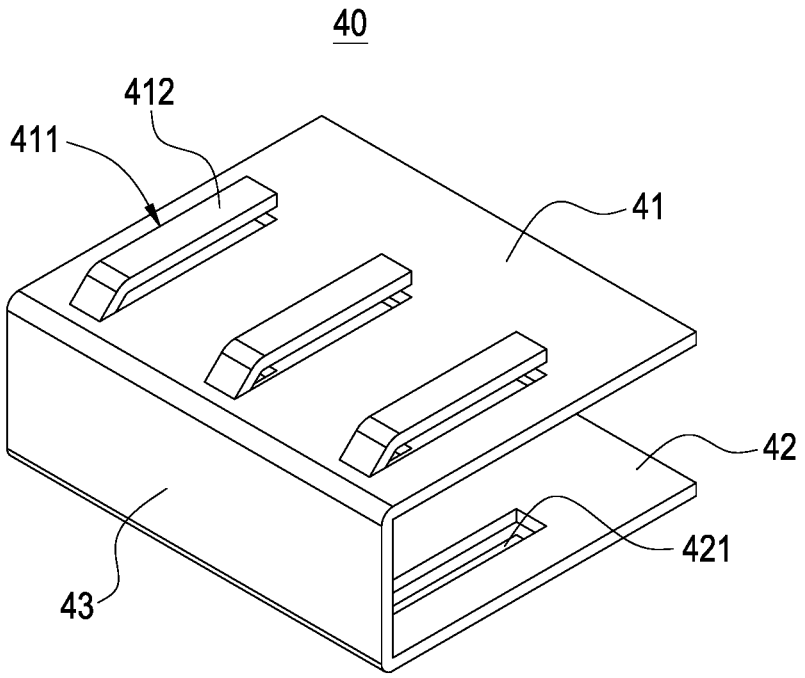
FIG. 1 is a perspective view of the ground assembly of the disclosure.

Please refer to FIG. 1. The ground assembly 40 is made of material with desirable conductivity, such as copper or an alloy thereof. In the embodiment, the ground assembly 40 has a cross section with a substantial U-shape and includes an upper plate 41, a lower plate 42 formed under the upper plate and an intermediate plate 43 connected between lateral sides of the upper plate 41 and the lower plate 42. The upper plate 41 and the lower plate 42 are substantially aligned and parallel to each other. The intermediate plate 43 is perpendicular to the upper plate 41 and the lower plate 42.

The upper plate 41 is pressed to be formed with multiple upper protrusion structures 411. In the embodiment, the upper protrusion structures 411 are three in number. The upper protrusion structures 411 are arranged spacedly. Each upper protrusion structure 411 is approximately a rectangular sheet. A side of the upper protrusion structure 411 is extended from the upper plate 41, and the other three sides are separated from the upper plate 41. A top of each protrusion structure 411 is higher than a surface of the upper plate 41. Similarly, the lower plate 42 is pressed to be formed with multiple lower protrusion structures 421 corresponding to the upper protrusion structures 411 of the upper plate 41. Each lower protrusion structure 421 is the same as the upper protrusion 411 in shape and pattern.

Furthermore, apart from the abovementioned shape, the ground assembly 40 may also have an H-shaped or a Z-shaped cross section (not shown).

Figure 2:
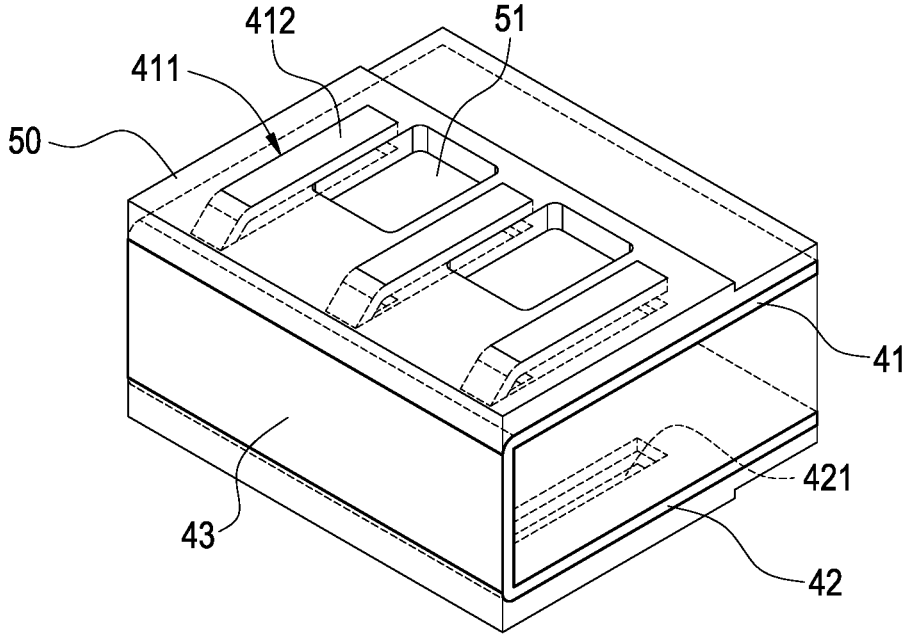
FIG. 2 is a schematic view of the combination of the ground assembly and the insulator of the disclosure.
Figure 3:
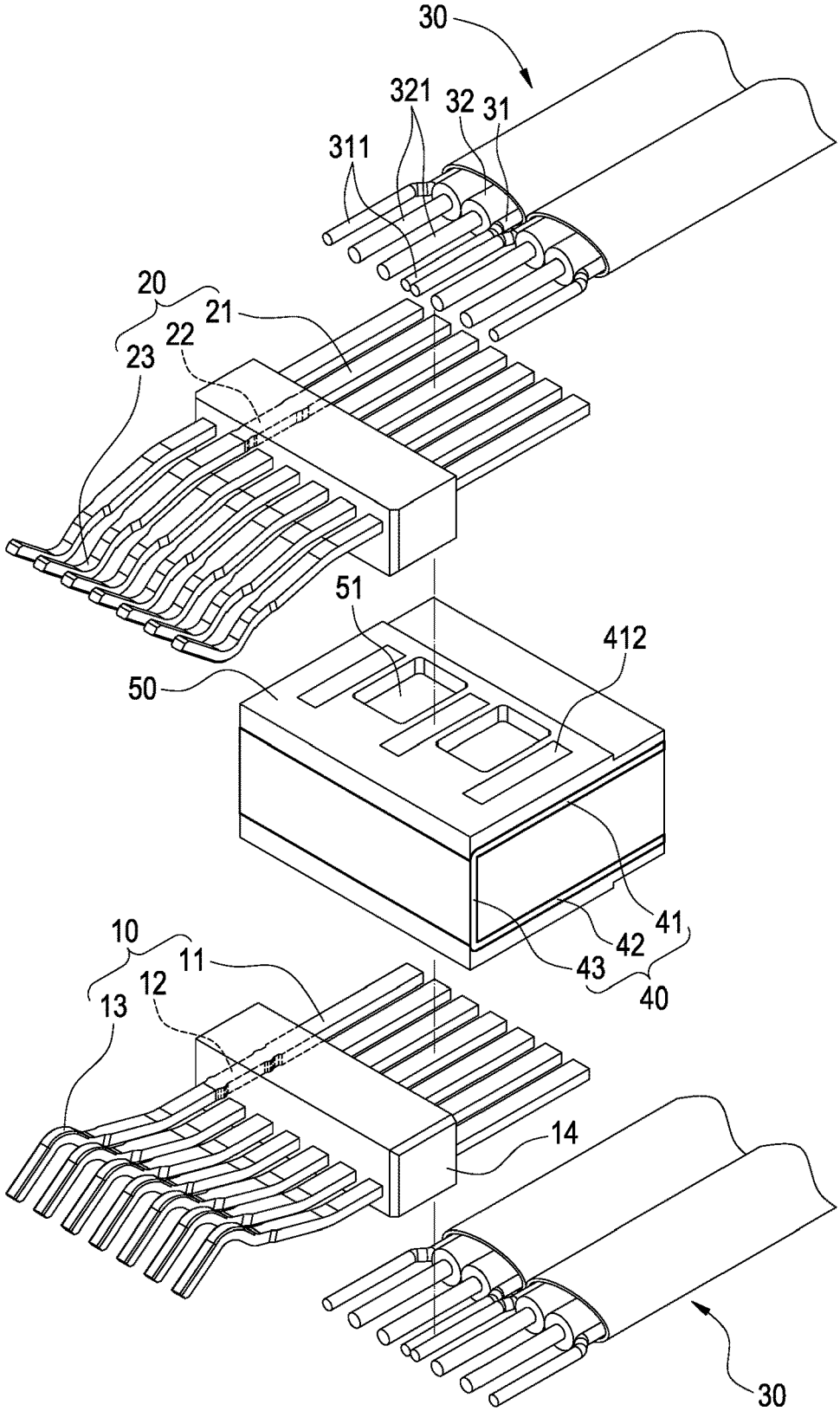
FIG. 3 is an exploded view of the connector of the disclosure.
Figure 4:
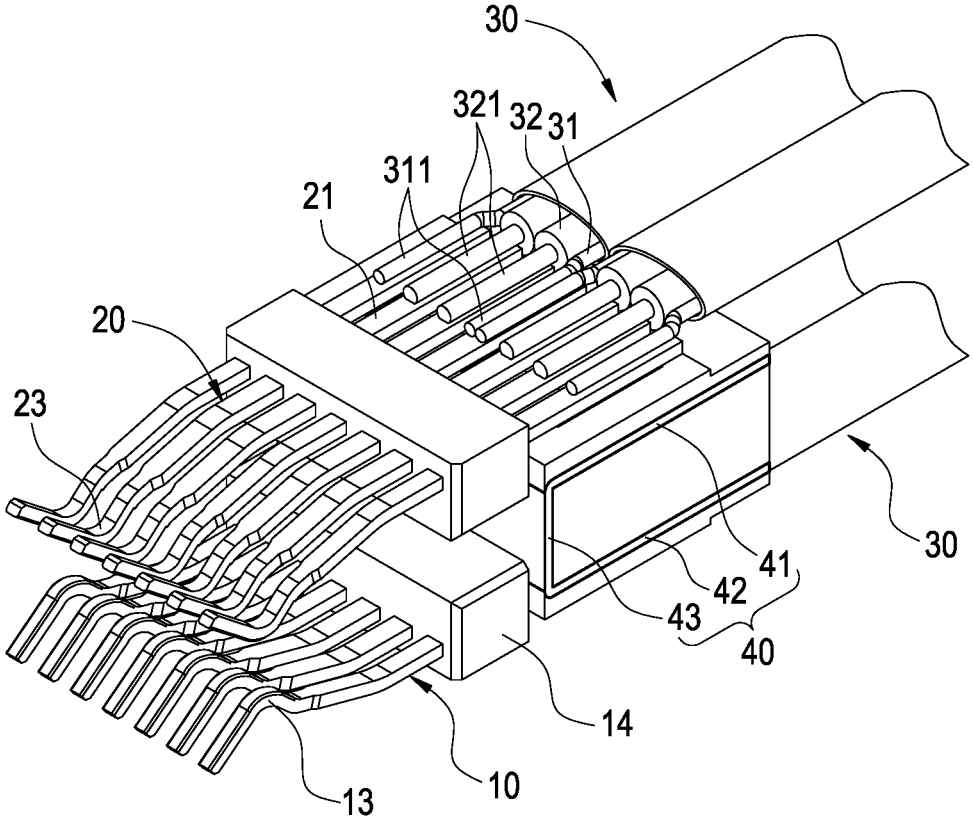
FIG. 4 is an assembled view of the connector of the disclosure.
Figure 5:
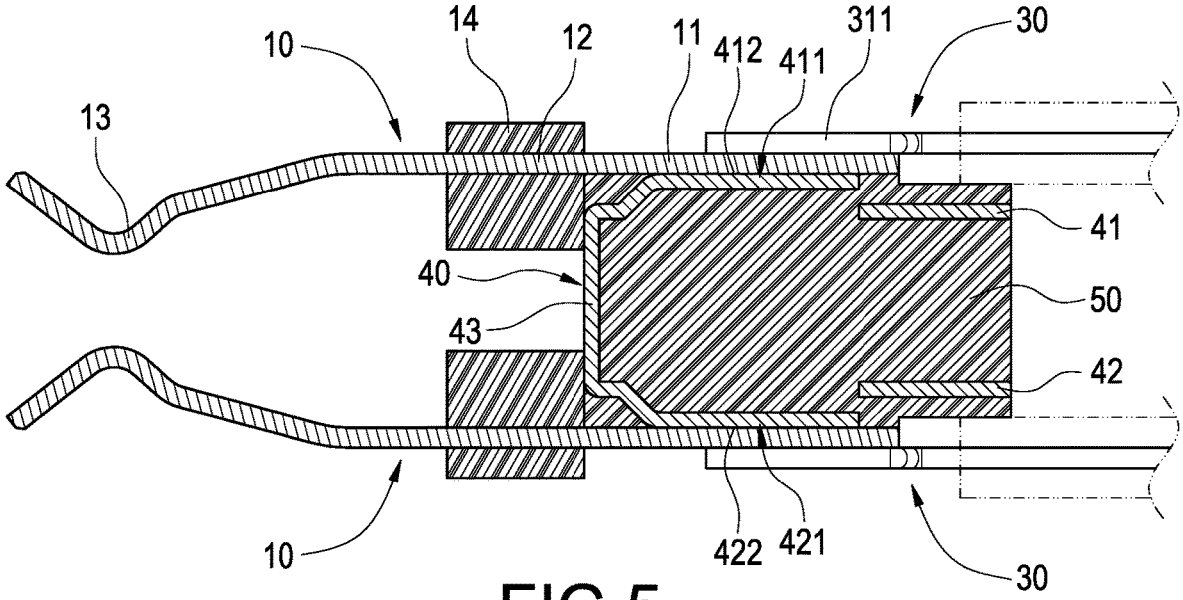
FIG. 5 is a cross-sectional view of the connector of the disclosure.
Figure 6:
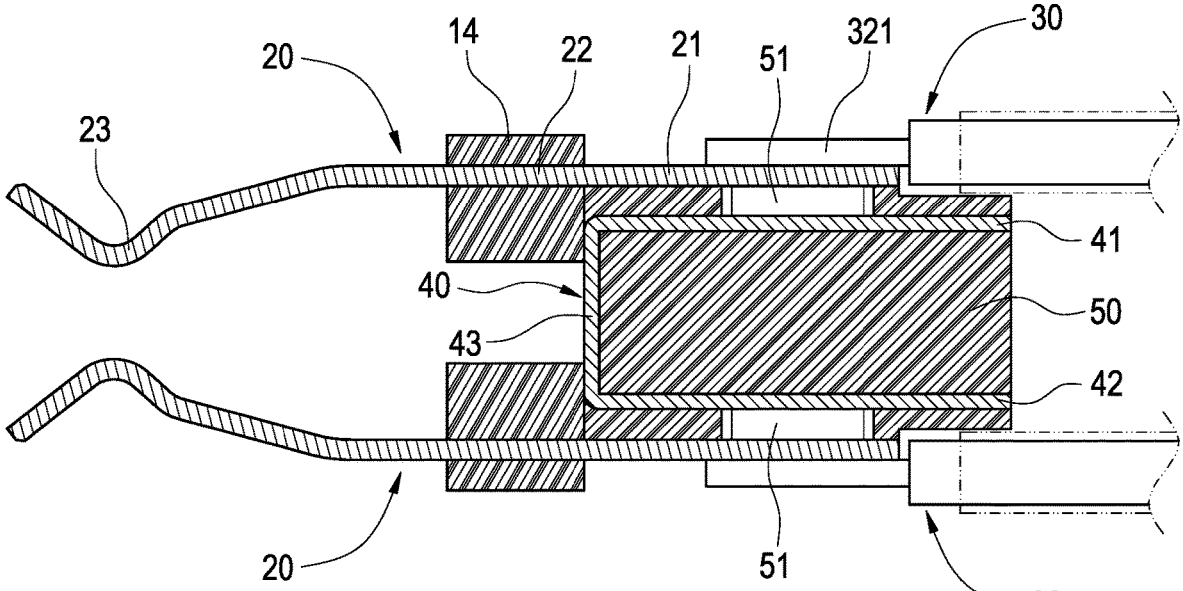
FIG. 6 is another cross-sectional view of the connector of the disclosure.
Figure 7:
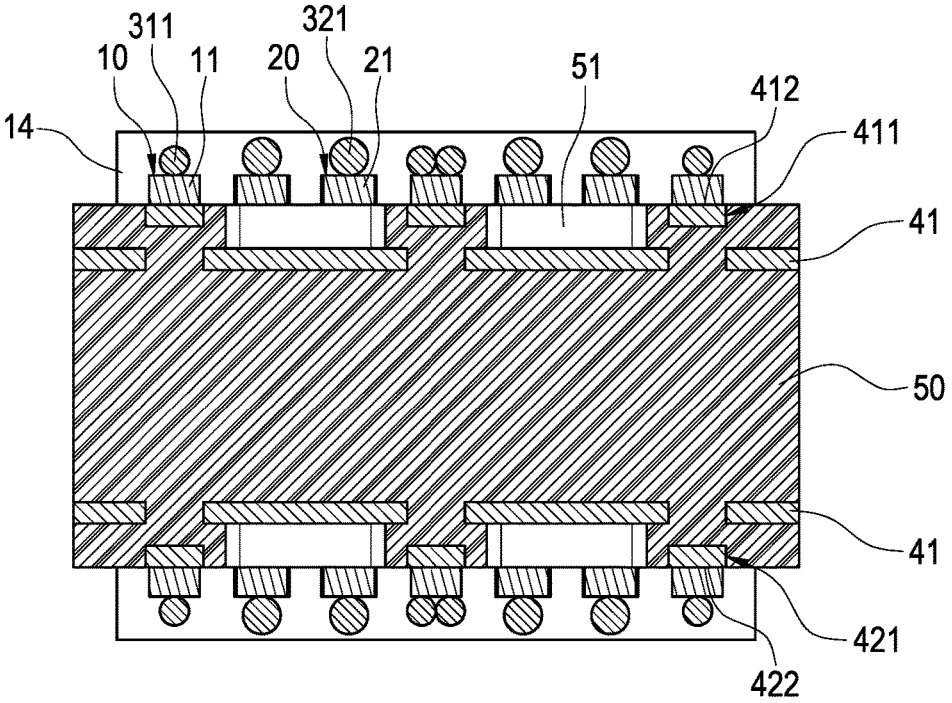
FIG. 7 is still another cross-sectional view of the connector of the disclosure.

Please refer to FIG. 2. The connector of the disclosure further includes an insulator 50, which may be made of plastic material with desirable insulation. The insulator 50 is formed on the ground assembly 40 by injection coating manner. The area of each upper protrusion structure 411, which is not covered by the insulator 50, is formed with a conducting surface 412. Similarly, the area of each lower protrusion structure 421, which is not covered by the insulator 50, is formed with a conducting surface 422.

Furthermore, a recess 51 is formed on the insulator 50 located between any two of the conducting surfaces 412 adjacent to each other. The shape of the recess 51 may be a polygon. In the embodiment, the shape of the recess 51 is a rectangle. The recess 51 is used to adjust the characteristic impedance of the signal terminals 20, especially the characteristics of reactance for capacitors and inductors. A width, length and depth of the recess 51 may be varied according to the needs. The signal terminals 20 has the smallest impedance when the recess 51 is fully filled. The signal terminals 20 has the largest impedance when the recess 51 penetrates through two opposite sides (that is, the insulator 50 between any two of the protrusion structures 411 adjacent to each other and located on the upper plate 41 is carved out.).

Please refer to FIGS. 3-7. Each ground terminal 10 includes a conducting section 11, a fixing section 12 extended from the conducting section 11 and an abutting section 13 extended from the fixing section 12. The abutting section 13 is away from the conducting section 11 and is formed at an end of the fixing section 12.

Each signal terminal 20 includes a conducting section 21, a fixing section 22 extended from the conducting section 21 and an abutting section 23 extended from the fixing section 22. The abutting section 23 is away from the conducting section 21 and is formed at an end of the fixing section 22.

Each ground terminal 10 and each signal terminal 20 are arranged spacedly. An insulative seat 14 is formed on the fixing sections 12, 22 by injection coating manner. There are two insulative seats 14 in the embodiment. Each insulative seat 14 is provided with three ground terminals 10 and four signal terminals 20. The three ground terminals 10 are separately arranged at the first, fourth and seventh positions and the four signal terminals 20 are separately arranged at the second, third, fifth and sixth positions.

There are two cables 30 in the embodiment. Each cable 30 includes two ground wires 31 and two signal wires 32. The two ground wires 31 are located outside the two signal wires 32. Each ground wire 31 has a core line 311. Each signal wire 32 also has a core line 321. In addition, each cable 30 may only include one ground wire 31 and one signal wire 32.

When assembling, the inside of each insulative seat 14 abuts against the intermediate plate 43 of the ground assembly 40 and a front end of the insulator 50. Each cable 30 is placed at an end of the insulator 50, which is located away from the insulative seat 14. The conducting section 11 of each ground terminal 10 is separately mounted (lapped) on each conducting surface 412, 422 and the core line 311 of each ground wire 31 is separately mounted (lapped) on the conducting section 11 of each ground terminal 10. The conducting section 21 of each signal terminal 20 straddles over each recess 51 for the core line 321 of each signal wire 32 to be mounted. The conducting section 21 is soldered by a soldering process to complete the electric connection.

Figure 8:
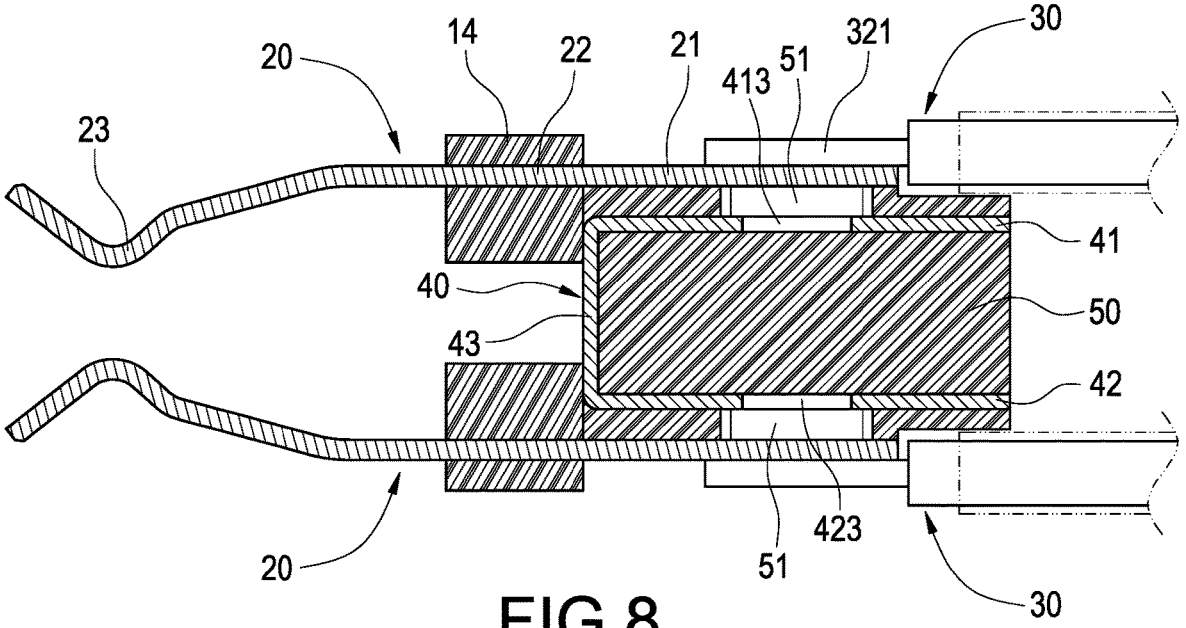
FIG. 8 is an assembled cross-sectional view of another embodiment of the disclosure.

Please refer to FIG. 8. Apart from the above embodiment, the connector of the disclosure may be the embodiment shown in the figure. The upper plate 41 is formed with multiple openings 413. Each opening 413 is located between any two of the upper protrusion structures 411 adjacent to each other, so that the characteristic impedance may be adjusted by the openings 413. Also, when the length of the opening 413 is increased, the characteristic impedance is increased correspondingly.

Furthermore, the opening 413 of the embodiment is arranged corresponding to the recess 51 in position and formed under the junction of the conducting section 21 of the signal terminal 20 and the core line 321 of the signal wire 32. The opening 413 may be greater than, equal to or less than the recess 51 in size.

In addition, the upper plate 41 may be formed with the opening 413 when the insulator 50 does not have the recess 51 (that is, being filled), such that the characteristic impedance may still be adjusted.

Similarly, the lower plate 42 may also be formed with multiple openings 423 to obtain the same effect.

While this disclosure has been described by means of specific embodiments, numerous modifications and variations could be made thereto by those skilled in the art without departing from the scope and spirit of this disclosure set forth in the claims.

What is claimed is:

1. An electrical connector, comprising:

multiple ground terminals;

multiple signal terminals;

a cable, comprising multiple ground wires and multiple signal wires;

a ground assembly, comprising a plate and multiple protrusion structures, each protrusion structure arranged spacedly and extended from the plate, a top of each protrusion structure being higher than a surface of the plate, each ground wire electrically connected with each ground terminal and each protrusion structure, each signal wire electrically connected with each signal terminal, and each signal wire disposed between any two of the protrusion structures adjacent to each other; and an insulator, partially covering the ground assembly, wherein a conducting surface is disposed on an area of each protrusion structure uncovered by the insulator, wherein a recess is disposed on the insulator located between any two of the conducting surfaces adjacent to each other, and each recess is arranged corresponding to each signal wire and each signal terminal;

wherein each signal terminal comprises a conducting section, each signal wire comprises a core line, and the conducting section and the core line are lapped with each other and arranged corresponding to the recess; and wherein an opening is disposed on the plate located between any two of the protrusion structures adjacent to each other, and the opening is disposed below the conducting section.

2. The electrical connector of claim 1, wherein each ground terminal comprises a conducting section, each ground wire comprises a core line, and the conducting section of each ground terminal and the core line of the ground wire are lapped with each other and jointly combined on the conducting surface.

3. The electrical connector of claim 1, wherein the recess is of a polygonal shape.

4. The electrical connector of claim 1, wherein the recess is of a rectangular shape.

5. The electrical connector of claim 1, wherein the opening is disposed below the recess.

6. The electrical connector of claim 5, wherein the opening is greater than, equal to or less than the recess in size.

7. The electrical connector of claim 1, wherein a cross section of the ground assembly is of a U-shape, an H-shape or a Z-shape.

8. The electrical connector of claim 1, wherein the plate comprises an upper plate, a lower plate disposed under the upper plate and an intermediate plate connected between the upper plate and the lower plate, the protrusion structure comprises an upper protrusion structure and a lower protrusion structure, each upper protrusion structure is disposed on the upper plate by a pressing manner, and each lower protrusion structure is disposed on the lower plate by the pressing manner.

9. The electrical connector of claim 1, wherein each ground terminal and each signal terminal are arranged spacedly, and an insulative seat is disposed on each ground terminal and each signal terminal by an injection coating manner.

* * * * *